US006695584B2

(12) United States Patent
Kim et al.

(10) Patent No.: US 6,695,584 B2
(45) Date of Patent: Feb. 24, 2004

(54) TURBO FAN

(75) Inventors: Seong Chun Kim, Seoul (KR); Young Min Park, Incheon (KR); Jong Han Park, Gwangmyeong (KR); Jun Sei Lee, Seoul (KR); Sung Oh Choi, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/042,206

(22) Filed: Jan. 11, 2002

(65) Prior Publication Data

US 2003/0044280 A1 Mar. 6, 2003

(30) Foreign Application Priority Data

Aug. 28, 2001 (KR) ..... 2001-52193

(51) Int. Cl.[7] ..... F04D 29/30

(52) U.S. Cl. ..... 416/186 R; 416/214 A; 416/223 A; 416/223 B

(58) Field of Search ..... 416/185, 186 R, 416/214 A, 223 A, 223 B

(56) References Cited

U.S. PATENT DOCUMENTS 3,221,398 A * 12/1965 Mayne ..... 29/889.4
6,224,335 B1 * 5/2001 Parisi et al. ..... 415/206
6,299,409 B1 * 10/2001 Matsunaga et al. ..... 415/206

* cited by examiner

*Primary Examiner*—Ninh H. Nguyen
(74) *Attorney, Agent, or Firm*—Birch, Stewart, Kolasch & Birch, LLP

(57) ABSTRACT

A turbo fan comprises: a hub coupled to a rotational shaft of a driving device; a plurality of blades installed on an outer circumference of the hub in a radial direction; and a shroud connected to the plurality of blades on opposite side of the hub centering around the blades; wherein a leading edge of the blade comprises: a connection part which is connected to the shroud; an extension part which is extended as a straight line parallelly with the rotational shaft from the hub; and a curved surface part which is formed as a convex curved surface between the extension part and the connection part.

2 Claims, 4 Drawing Sheets

NOISE 46.9 dB

NOISE 48.2 dB

NOISE 45.8 dB

TURBO FAN

BACKGROUND OF THE INVENTION

1. Field of the Invention

The present invention relates to a turbo fan, and more particularly, to a blade structure for a turbo fan.

2. Description of the Background Art

Generally, a blast fan is used for sending air by the rotational force of a disc wheel or a rotor, to a refrigerator, an air conditioner, and/or a cleaner. Specifically, blast fans can be divided into various types, including axial fans, sirocco fans, and turbo fans according to their respective methods for drawing in and discharging air and/or the shape of the fan.

The turbo fan draws in air from a shaft direction of the fan, and discharges the air through a side surface part of the fan in a radial direction. The turbo fan does not include a duct because the air is naturally sucked into the fan and discharged to the outside. This type of fan is typically applied to relatively large sized equipment, e.g., such as ceiling air conditioners.

FIG. 1 is a plan view showing a conventional turbo fan of the background art, and FIG. 2 is a longitudinal, cross-sectional view showing the conventional turbo fan of the background art. As shown in FIGS. 1 and 2, the conventional turbo fan includes a shroud 4; a hub 2 to which a driving device (not shown) is coupled; and a plurality of blades 3 disposed on an outer circumference of the hub 2 in a radial direction and having one side coupled to the shroud 4.

According to the structure described above, the turbo fan 1 includes a suction part 7 for sucking the air on an upper part, a plurality of flow paths 6 for inducing the air which is drawn in through the suction part 7, and a plurality of discharge parts 8 for discharging the air on a side surface part.

The operation of the conventional turbo fan having the above-described structure will be described hereinafter as follows. When the turbo fan 1 is rotated by the driving force of the driving device (not shown), the air is drawn into the suction part 7 by the rotation of the blades 3, and the air which is drawn in through the suction part 7 is discharged to the discharge parts 8 via the flow paths 7.

However, in the blades of the conventional turbo fan, a leading edge on a center part between an end part on the hub side and an end part on the shroud side is formed along a straight line as shown in FIG. 2. A curved part or a bent part may be formed on the hub side in order to get a needed area for the blades.

However, the shape of the blades 3 in the conventional turbo fan is not suitable for "L" shape air flow, that is, the air is sucked from the suction part 7 and discharged to the discharge part 8, and therefore noise may be generated by unstable air flows, e.g., such as vortex flow, and the efficiency of the turbo fan is reduced.

SUMMARY OF THE INVENTION

The present invention overcomes the shortcomings associated with the background art and achieves other advantages not realized by the background art.

Therefore, an object of the present invention is to provide a turbo fan including a blade having a shape which is able to reduce noise and increase efficiency by preventing unstable air flows such as vortex flow in "L" shaped air flows in the turbo fan.

These and other objects are accomplished by a turbo fan comprising a driving device having a rotational shaft; a hub coupled to the rotational shaft of the driving device; a plurality of blades being installed on an outer circumference of the hub and extending in a radial direction; and a shroud coupled to the blades on an opposite side of the hub centering around the blades; wherein a leading edge of each of said blades comprises a coupling part being coupled to the shroud; an extension part extending along a straight line parallel with the rotational shaft and extending away from the hub; and a curved surface part formed having a convex curved surface extending between the extension part and the coupled part, wherein the extension part of the blade extends away from the outer circumferential surface of the hub approximately 40%–60% of a distance (D) measured from the coupling part where the blade and the shroud are coupled to each other to the outer circumferential surface of the hub.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
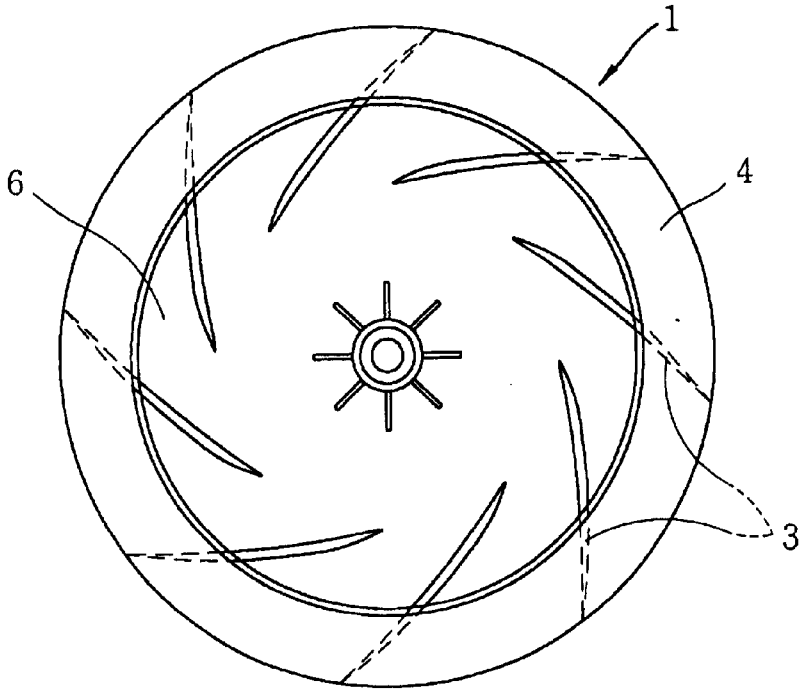
FIG. 1 BACKGROUND ART
FIG. 1 is a plan view showing a conventional turbo fan of the background art.
Figure 2:
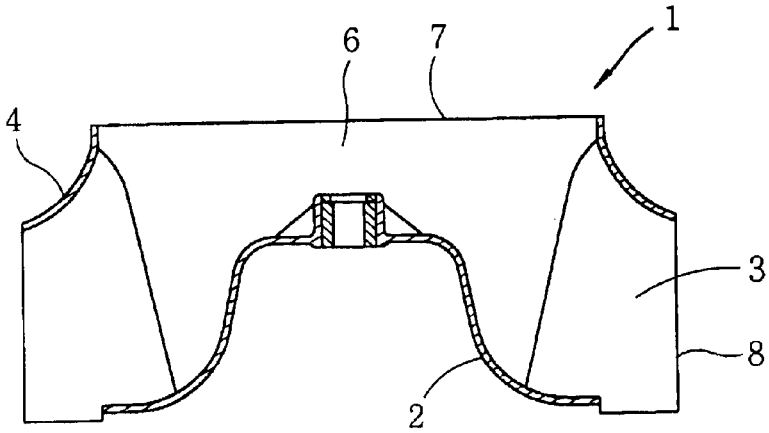
FIG. 2 BACKGROUND ART
FIG. 2 is a longitudinal cross sectional view showing the conventional turbo fan of the background art.
Figure 3:
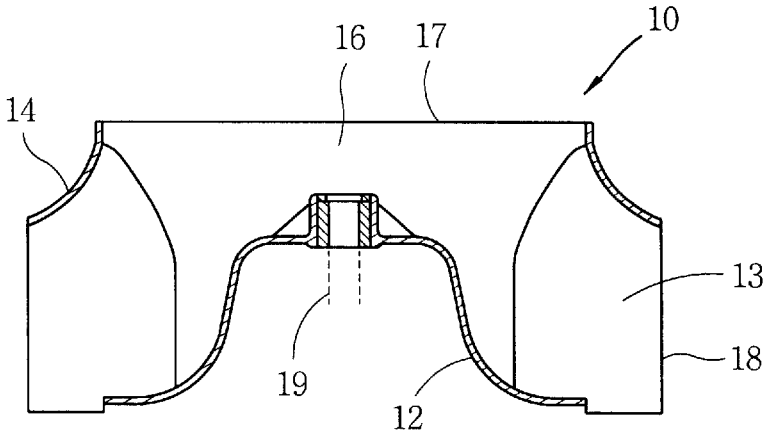
FIG. 3 is a longitudinal cross sectional view showing a turbo fan according to the present invention.
Figure 4:
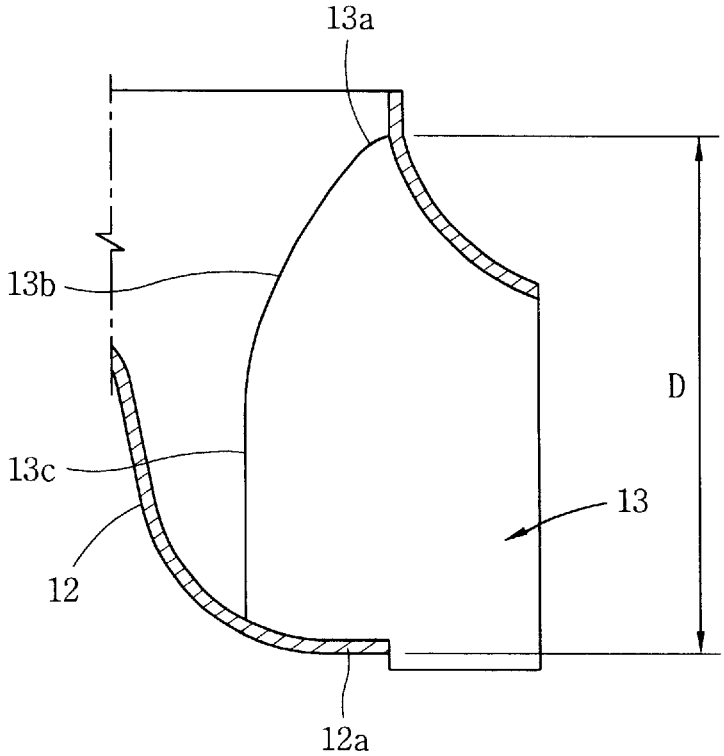
FIG. 4 is an enlarged cross sectional view showing principal parts in FIG. 3.

FIG. 3 is a longitudinal cross-sectional view showing a turbo fan according to the present invention, and FIG. 4 is an enlarged cross sectional view showing principal parts of the turbo fan in FIG. 3.

As shown in FIG. 3, the turbo fan 10 according to the present invention includes a hub 12 which is coupled to a rotational shaft 19 of a driving device (not shown); a plurality of blades 13 which are installed on an outer circumferential face 12*a* of the hub 12 in a radial direction; and a shroud 14 coupled to the plurality of blades 13 on an opposite side of the hub 12 centering around the blades 13.

A leading edge of the blade 13 includes a coupling part 13*a* which is coupled to the shroud; an extension part 13*c* which extends along a line parallel with the rotational shaft 19 from the hub 12; and a curved surface part 13*b* which formed as a convex curved surface between the extension part 13*c* and the coupling part 13*a*. It is desirable that a length of the extension part 13*c* of the blade is equal to approximately 40%–60% of a distance D between the outer circumferential surface 12*a* of the hub 12 and the coupled part of the blade 13 and the shroud 14.

According to the above-described structure, the turbo fan 10 includes a suction part 17 for drawing in air on an upper part; a plurality of flow paths 16 for inducing the air which is drawn in through the suction part 17 at a center part; and a plurality of discharge parts 18 for discharging the sucked air on a side part.

An operation of the turbo fan according to the present invention will be described hereinafter. When the turbo fan 10 is rotated by the driving of the driving device (not shown), the outer air is sucked into the suction part 17 by the rotation of the blades 13, and the air sucked through the suction part 17 is discharged to the discharge part 18 via the flow paths 16.

Figure 5A:
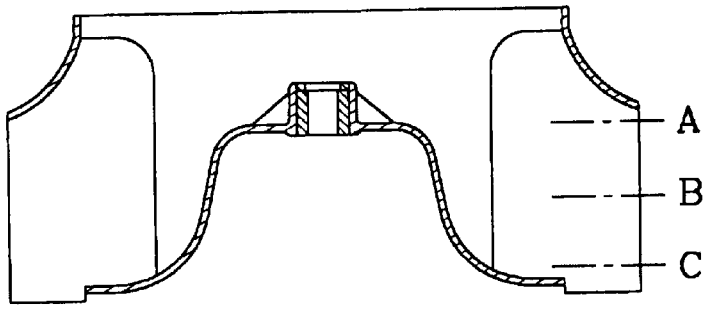
FIGS. 5A, 5B, and 5C are longitudinal cross sectional views showing a turbo fan in which a leading edge of a blade is formed as a straight line, the conventional turbo fan of the background art, and the turbo fan according to the present invention, respectively.
Figure 5B:
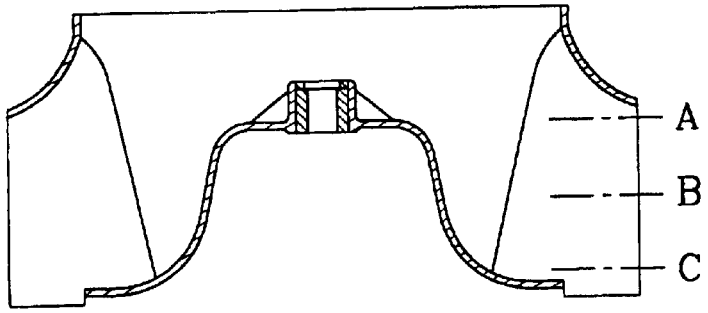
FIG. 5B BACKGROUND ART
Figure 5C:
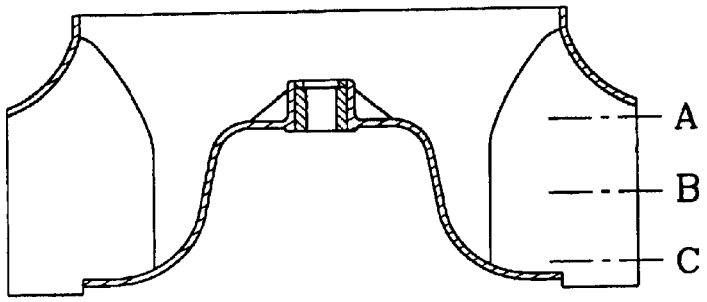
Figure 6A:
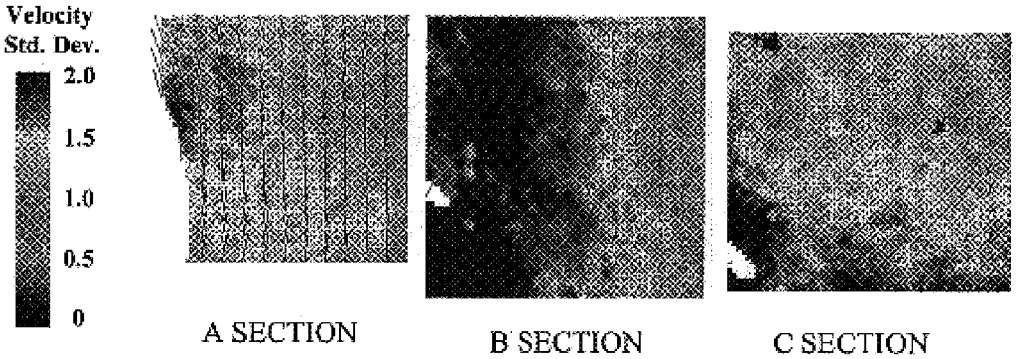
FIGS. 6A, 6B, and 6C are graphical views showing air flows and noise generation on respective parts of the turbo fans in FIGS. 5A, 5B, and 5C when a wind wave is 18.5 $m^3$/min.
Figure 6B:
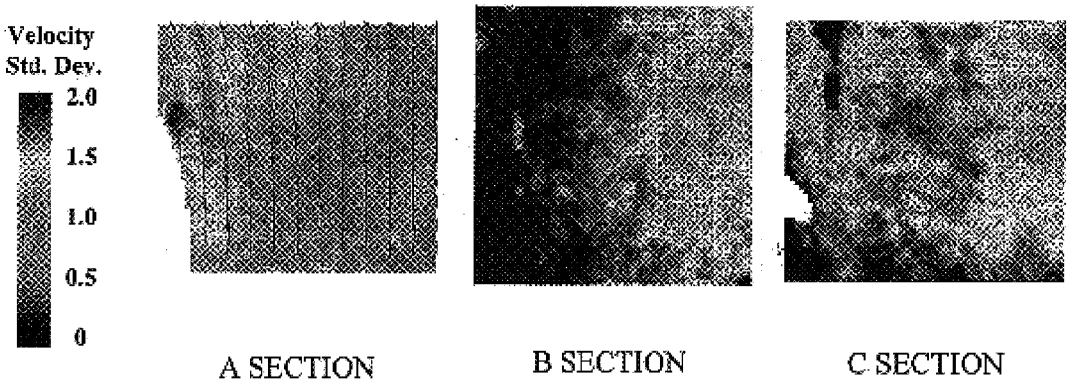
Figure 6C:
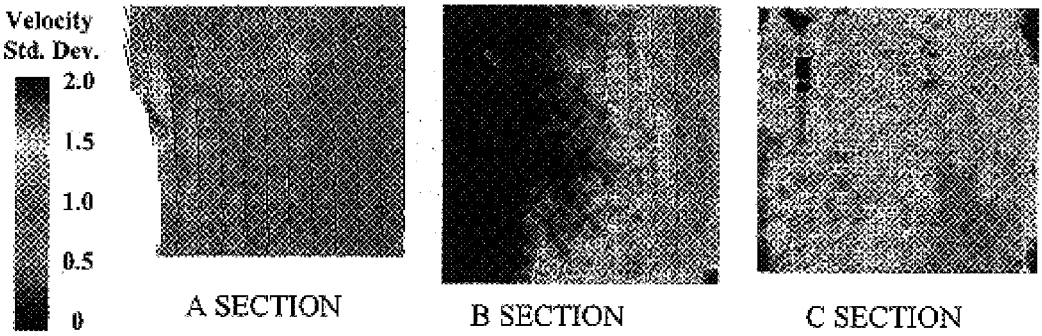

FIGS. 5A, 5B, and 5C are longitudinal cross sectional view showing a turbo fan in which the leading edge of the blade is formed as a straight line, the conventional turbo fan, and the turbo fan according to the present invention. FIGS. 6A, 6B, and 6C are graphs showing air flows and noise generation on respective parts of the turbo fans in FIGS. 5A, 5B, and 5C when the wind wave is 18.5 $m^3$/min.

FIGS. 5A, 5B and 5C and FIGS. 6A, 6B, and 6C are experimental examples, and the blade 13 in the turbo fan 10 according to the present invention in FIG. 5C is formed vertically from the outer circumferential surface 12*a* of the hub 12, and the extension part 13*c* is formed so as to extend a bout 50% of the distance D from the outer circumferential surface 12*a* of the hub 12 to a part where the blade 13 and the hub 12 are coupled to each other.

As shown in FIGS. 6A, 6B, and 6C, when the wind wave of the turbo fan is 18.5 $m^3$min, the air flows on the respective parts of the turbo fan according to the present invention have less velocity standard deviation than that of the conventional turbo fan. Therefore, the speed of the air flowing is distributed evenly and the noise generated when the turbo fan is operated is reduced.

The turbo fan according to the present invention is able to increase the capacity of the turbo fan by enlarging the cross sectional area of the blade 13. At the same time, the turbo fan of the present invention is able to reduce noise by reducing vortex flow due to the "L" shaped air flows in the turbo fan and other unstable air flows.

As the present invention may be embodied in several forms without departing from the spirit or essential characteristics thereof, it should also be understood that the above-described embodiment s a re not limited by any of the details of the foregoing description, unless otherwise specified, but rather should be construed broadly within its spirit and scope as defined in the appended claims, and therefore all changes and modifications that fall within the mete s and bounds of the claims, or equivalence of such metes and bounds are therefore intended to be embraced by the appended claims.

What is claimed is:

1. A turbo fan comprising:

a driving device having a rotational shaft;

a hub coupled to the rotational shaft of the driving device;

a plurality of blades being installed on an outer circumference of the hub and extending in a radial direction; and a shroud coupled to the blades on an opposite side of the hub centering around the blades; wherein a leading edge of each of said blades comprises a coupling part being coupled to the shroud;

an extension part extending along a straight line parallel with the rotational shaft and extending away from the hub; and a curved surface part formed having a convex curved surface extending between the extension part and the coupled part, wherein the extension part of the blade extends away from the outer circumferential surface of the hub approximately 40%–60% of a distance (D) measured from the coupling part where the blade and the shroud are coupled to each other to the outer circumferential surface of the hub.

2. The turbo fan according to claim 1, wherein the extension part of the blade extends away from the outer circumferential surface of the hub approximately 50% of the distance (D) measured from the coupling part where the blade and the shroud are coupled to each other to the outer circumferential surface of the hub.

* * * * *